US009604222B2

(12) United States Patent
Fredsall

(10) Patent No.: US 9,604,222 B2
(45) **Date of Patent: *Mar. 28, 2017**

(54) CUTTER ASSEMBLY FOR GRINDING AND CRUSHING MACHINES

(71) Applicant: Gil Fredsall, Winsted, CT (US)

(72) Inventor: Gil Fredsall, Winsted, CT (US)

(73) Assignee: Associated Mechanics Network, LLC, Winsted, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/718,032

(22) Filed: May 20, 2015

(65) Prior Publication Data

US 2015/0360230 A1 Dec. 17, 2015

Related U.S. Application Data

(63) Continuation of application No. 13/433,998, filed on Mar. 29, 2012, now Pat. No. 9,038,933.

(60) Provisional application No. 61/470,027, filed on Mar. 31, 2011, provisional application No. 61/561,562, filed on Nov. 18, 2011.

(51) Int. Cl.

| | |
|---|---|
| ***B02C 18/00*** | (2006.01) |
| ***B02C 18/18*** | (2006.01) |
| ***B02C 18/14*** | (2006.01) |
| ***B02C 18/06*** | (2006.01) |
| ***B02C 13/06*** | (2006.01) |
| ***B02C 13/28*** | (2006.01) |

(52) U.S. Cl.

CPC ..... *B02C 18/184* (2013.01); *B02C 13/06* (2013.01); *B02C 13/2804* (2013.01); *B02C 18/06* (2013.01); *B02C 18/145* (2013.01); *B02C 2013/2812* (2013.01); *B02C 2018/188* (2013.01)

(58) Field of Classification Search

CPC ..... B02C 13/28; B02C 13/2812; B02C 13/06; B02C 18/184; B02C 18/06; B02C 2018/145

USPC ..... 241/294, 195, 300, 191, 189.1, 197

See application file for complete search history.

(56) References Cited

U.S. PATENT DOCUMENTS

| | | | | |
|---|---|---|---|---|
| 2,558,107 A | | 6/1951 | Smith | |
| 2,854,047 A | | 9/1958 | Schmidt | |
| 4,117,985 A | | 10/1978 | Lazareck | |
| 4,604,931 A | * | 8/1986 | Bastian | B26F 1/14 279/76 |

(Continued)

*Primary Examiner* — Faye Francis
(74) *Attorney, Agent, or Firm* — MKG LLC

(57) ABSTRACT

A cutter assembly is presented for mounting to one or more hammers of a rotor assembly of a grinding machine. The cutter assembly includes a base, a tip and a fastener securing the base and the tip to the hammer. The base includes a key having side walls extending upwardly from a surface of the base and spatially oriented as sides of a pyramid that is truncated before reaching their apex. The tip includes a keyway having side walls extending inwardly from a lower surface into a body of the tip and spatially oriented as sides of a pyramid. The keyway mates with the key of the base. The tip includes at least one, and preferably two, cutting edges disposed on opposing ends of the tip. In one embodiment, the tip is reversibly mountable to the base such that the cutting edges may be selectively used within grinding operations. In one embodiment, at least a portion of side walls of the truncated pyramid key and keyway are curved in a plane parallel to the surface of the base.

13 Claims, 12 Drawing Sheets

(56) References Cited

U.S. PATENT DOCUMENTS

| | | | | |
|---|---|---|---|---|
| 4,969,605 | A | 11/1990 | Morin | |
| 5,146,963 | A | 9/1992 | Carpenter et al. | |
| 6,045,072 | A | 4/2000 | Zehr | |
| 6,079,649 | A | 6/2000 | Balvanz et al. | |
| 6,131,838 | A | 10/2000 | Balvanz et al. | |
| 6,419,173 | B2 | 7/2002 | Balvanz et al. | |
| 6,422,495 | B1 | 7/2002 | De Boef et al. | |
| 6,435,434 | B1 | 8/2002 | Monyak | |
| 6,464,157 | B1 | 10/2002 | Balvanz et al. | |
| 6,481,655 | B1 | 11/2002 | Feigel, Jr. | |
| 6,622,951 | B1 | 9/2003 | Recker et al. | |
| 6,758,776 | B2 * | 7/2004 | Fye | F16H 55/30 198/834 |
| 6,840,471 | B2 | 1/2005 | Roozeboom et al. | |
| 6,880,774 | B2 | 4/2005 | Bardos et al. | |
| 7,055,770 | B2 | 6/2006 | Bardos | |
| 7,216,682 | B1 | 5/2007 | Bennington | |
| 7,293,729 | B2 | 11/2007 | Ragnarsson | |
| 7,568,645 | B2 | 8/2009 | Doppstadt | |
| 7,624,490 | B2 | 12/2009 | Bardos | |
| 7,815,136 | B2 | 10/2010 | Arnston | |
| 7,959,097 | B2 | 6/2011 | De Boef | |
| 8,740,121 | B1 | 6/2014 | Cox et al. | |
| 9,038,933 | B2 * | 5/2015 | Fredsall | B02C 18/145 241/300 |
| 2001/0006199 | A1 | 7/2001 | Balvanz et al. | |
| 2002/0190148 | A1 | 12/2002 | Roozeboom et al. | |
| 2005/0035234 | A1 | 2/2005 | Roozeboom et al. | |
| 2005/0116074 | A1 | 6/2005 | Kusak | |
| 2010/0206973 | A1 | 8/2010 | Cotter et al. | |

* cited by examiner

CUTTER ASSEMBLY FOR GRINDING AND CRUSHING MACHINES

CROSS-REFERENCE TO RELATED APPLICATIONS

The present application is a continuation application of U.S. patent application Ser. No. 13/433,998 filed on Mar. 29, 2012, now U.S. Pat. No. 9,0378,933 issued on May 26, 2015, which in turn claims the benefit under 35 U.S.C. §119(e) of the Provisional Patent Application Ser. No. 61/470,027, filed Mar. 31 2011, and further claims the benefit of the Provisional Patent Application Ser. No. 61/561,562, filed Nov. 18, 2011, the disclosures of which are incorporated by reference in their entirety.

BACKGROUND OF THE INVENTION

1. Field of the Invention

This invention relates to grinding and crushing machines and, in particular, to cutter, hammer and/or striker assemblies for grinding and crushing machines.

2. Description of Related Art

Generally speaking, grindings or crushing machines reduce materials such as, for example, trees, stumps, brush, wood pallets, paper and the like, to a desired size. Typically, the material is fed into a reduction chamber where it encounters an impact rotor. Cutters, hammers or strikers (hereinafter collectively referred to as cutters) are mounted to projections of the rotor with a cutting or impact surface of each cutter aligned in a direction of rotation of the rotor. The cutting surface contacts the material tearing a portion from the material thus reducing the overall size of the material. A screen or filter maintains the material within the reduction chamber until it is reduced to the desired size (by repeated impact with the cutting surfaces of the cutters), after which, the screen or filter permits passage of the reduced materials out of the reduction chamber.

As can be appreciated, wear of the cutting surface and/or secure fastening of the cutters to the rotor, are significant concerns for operating and maintaining such grinding and crushing machines in a safe and efficient manner. Similarly, when replacement is needed, it is desirable to provide an arrangement that can be efficiently removed from the rotor and replaced with minimal time and labor.

There have been attempts at improving the safety and efficient of such grinding operations. However, the inventor has recognized that a need still exists for new and improved grinding and/or crushing operations.

BRIEF DESCRIPTION OF THE DRAWINGS

In these figures like structures are assigned like reference numerals, but may not be referenced in the description of all figures.

DETAILED DESCRIPTION OF PREFERRED EMBODIMENTS

Figure 1:
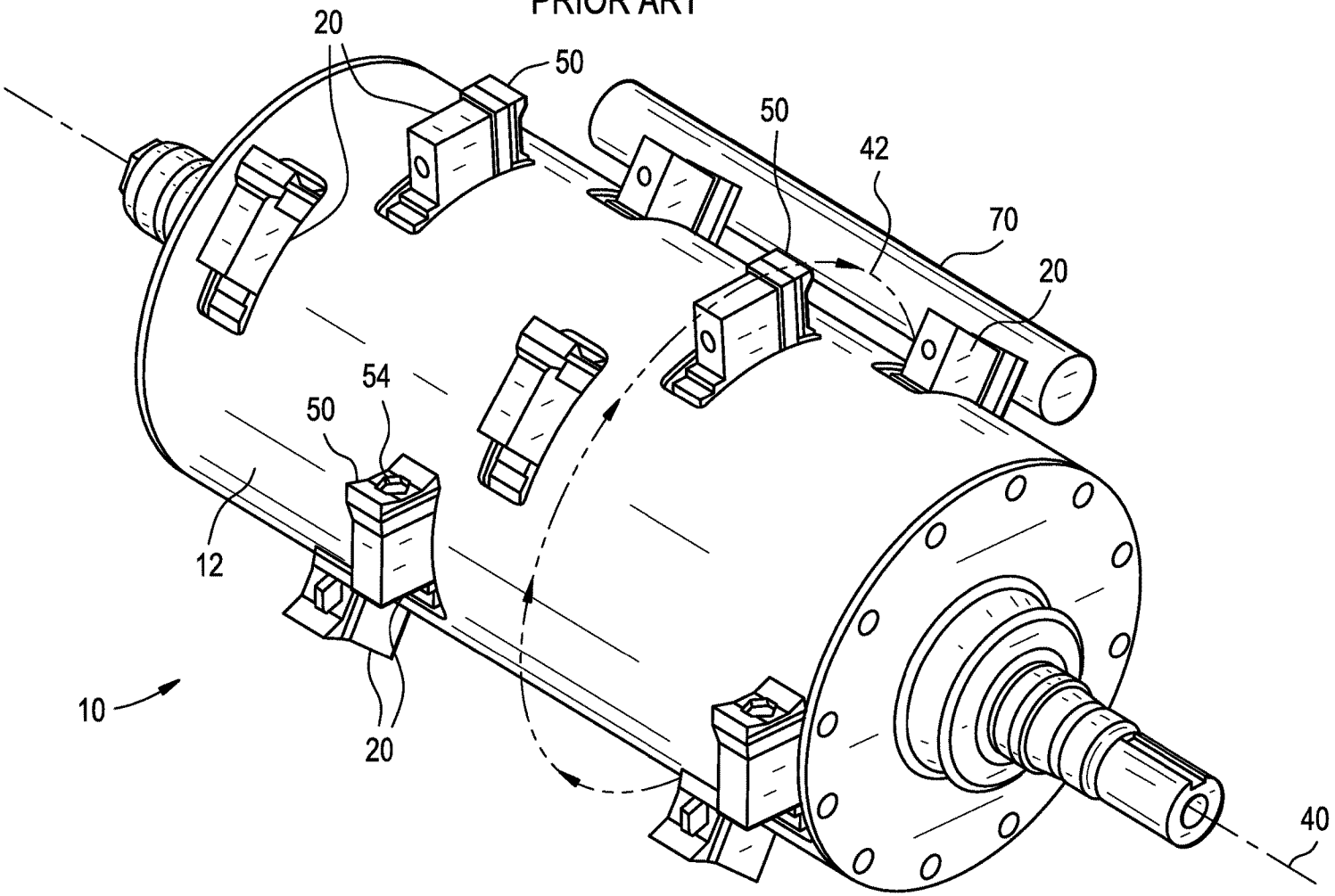
FIG. 1 PRIOR ART
FIG. 1 is a perspective view of a rotor assembly used in grinding operations, as is generally known in the art.
Figure 2:
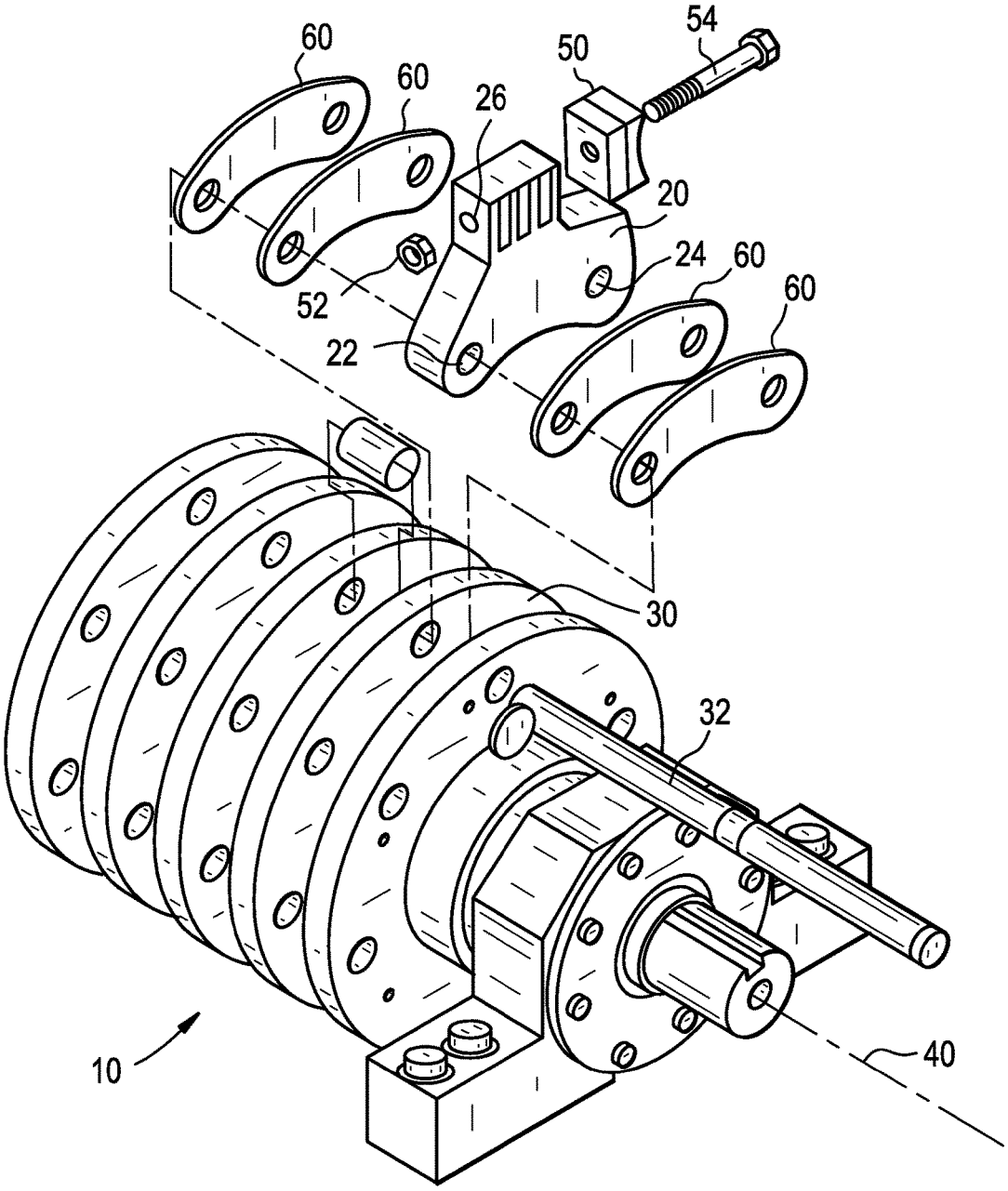
FIG. 2 PRIOR ART
FIG. 2 is a view of cutters, hammers and rotor plates of the rotor assembly of FIG. 1.

FIGS. 1 and 2 illustrate a rotor assembly 10 for a material grinding or crushing machine. As shown in FIGS. 1 and 2, a plurality of hammers 20 are secured to a plurality of rotor plates 30. The rotor plates 30 are rotatably driven about an axis of rotation 40. Cutters 50 (e.g., cutter blocks, cutter teeth, and the like) are mounted on the hammers 20 with fasteners such as, for example, a nut 52 and bolt 54. The hammers 20 are secured between the rotor plates 30 by shafts or rods 32 aligned generally parallel to the axis of rotation 40. For example, each hammer includes two holes 22 and 24 each positioned to receive a different one of the shafts 32. Shims 60 are mounted between the hammers 20 and the rotor plates 30. When the rotor plates 30 are rotated about the axis of rotation 40, the hammers 20 are carried by the rotor plates 30 in a generally circular path 42 about a housing 12 of the rotor assembly 10. Material 70 such as, for example, trees, stumps, brush, wood pallets, paper, shingles, asphalt, and the like, to be ground is fed into the circular path 42 such that the material 70 is impacted and reduced in size by the cutters 50 of the hammers 20.

As can appreciated, the impact of the cutters 50 on the material 70 imparts forces against the hammers 20, the cutters 50 and the fasteners 52 and 54 securing the cutters 50 to the hammers 20. The inventor has found that a more secure, and thus safer, mechanism exists for securing cutters 50 to hammers 20.

Figure 3A:
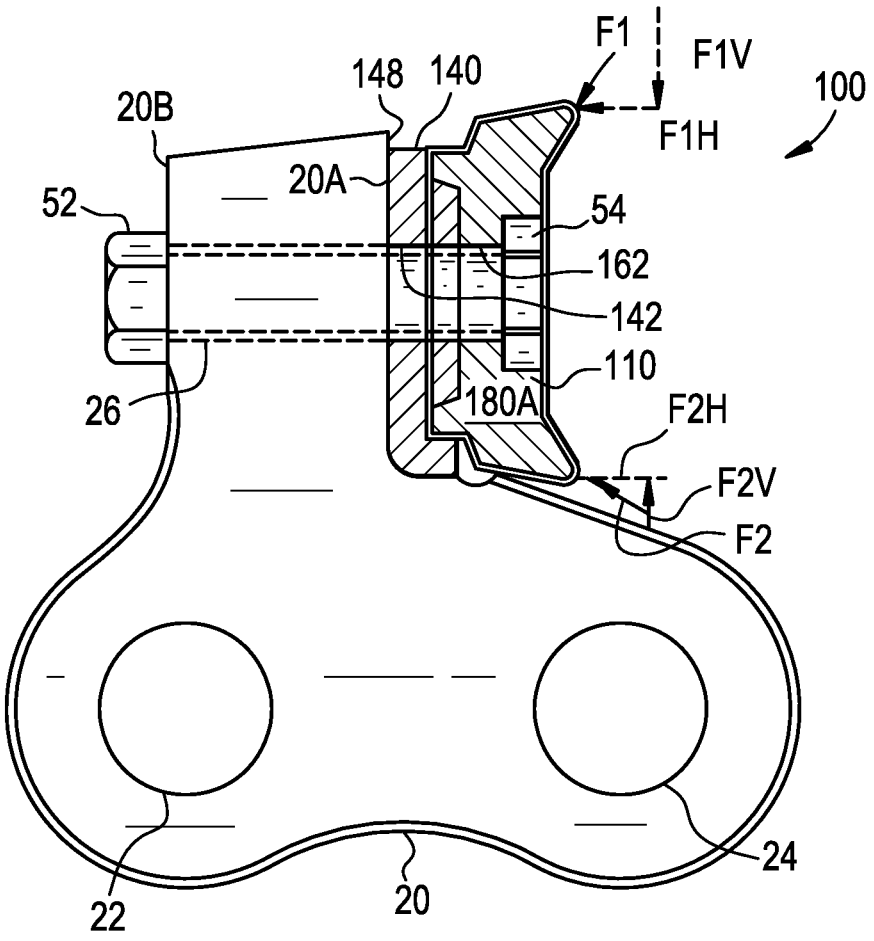
FIG. 3A is an elevation view, in partial cross section, of a cutter assembly mounted to one of the hammers, in accordance with one embodiment of the present invention.

Referring to FIG. 3A, a tip 110 and base 140 of an improved cutter assembly 100 are shown mounted to a first face 20A of the hammer 20 with fasteners such as, for example, the nut 52 and the bolt 54. The bolt 54 extends through a bore 112 within a body 110A of the tip 110, a bore 142 in the base 140, and a bore 26 of the hammer 20, and is received by the nut 52 at a second face 20B of the hammer 20. The first face 20A of the hammer 20 is in a direction of the circular path 42, while the second face 20B of the hammer is in a direction opposite the first face 20A. In one embodiment, the base 140 is mounted to the first face 20A by a weld joint 148.

It should be appreciated that while the tip 110 and the base 140 are shown mounted to the first face 20A of the hammer 20 with one nut 52 and one bolt 54 it is within the scope of the present invention for the tip 110 and the base 140 to include two or more of the bores 112 and 142 in each of the tip 110 and the base 140, respectively, to accommodate two or more sets of the nut 52 and one bolt 54 and thus secure different sized (e.g., larger in width and length) tip and base arrangements.

Figure 3B:
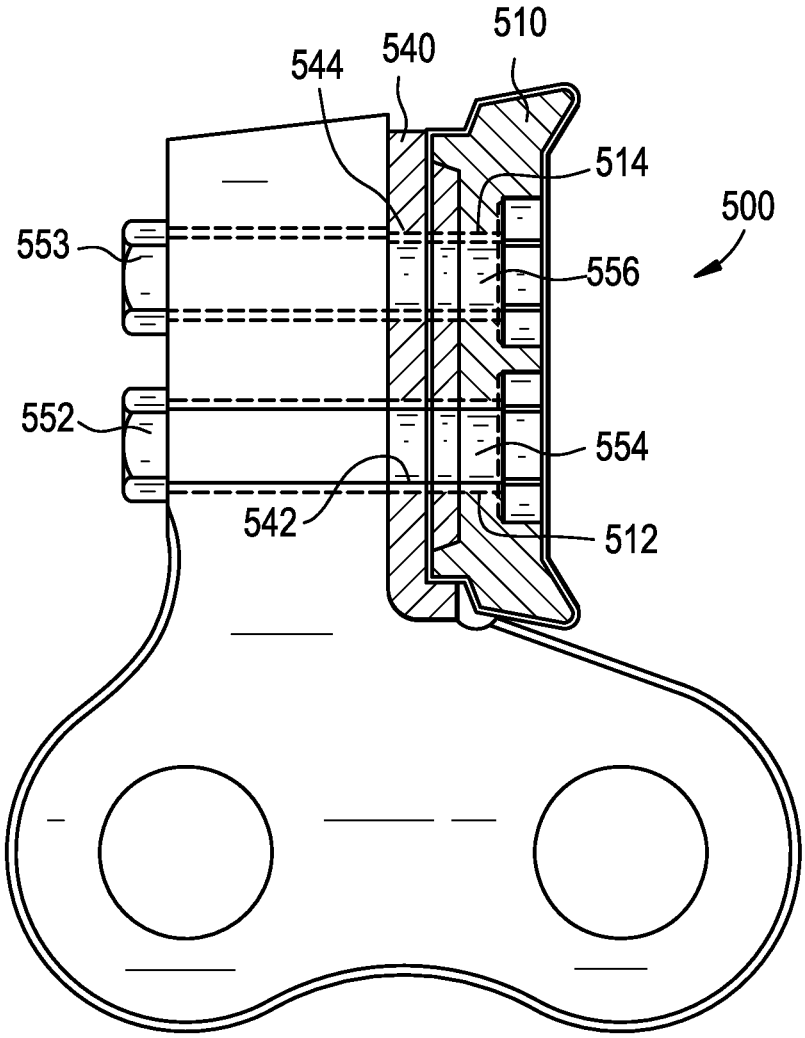
FIG. 3B is an elevation view, in partial cross section, of a cutter assembly mounted to one of the hammers, in accordance with one embodiment of the present invention.

For example, in reference to FIG. 3B an embodiment of an improved cutter assembly 500 is shown in which two bolts 554, 556 secure the tip 510 and the base 540 to the hammer 520. A first bolt 554 is received in a first bore 512 in the tip 510 and a first bore 542 in the base 540. A second bolt 556 is received in a second bore 514 in the tip 510 and a second bore 544 in the base 540. The bolts 554, 556 are secured in position with corresponding nuts 552, 553. The inventor has found that the use of two bolts 554, 556 are of particular advantage as compared to the use of one bolt, as the overall size of the tips 510 and bases 540 increases. With the increase in the number of bolts it is possible to increase the size of the tip 510 and base 540 without decreasing the integrity of the cutter assembly 500. As noted above, it is within the scope of the present invention to provide a variety of different sized tips and bases to accommodate different grinding and crushing machines, materials to be reduced, and/or applications.

Figure 4:
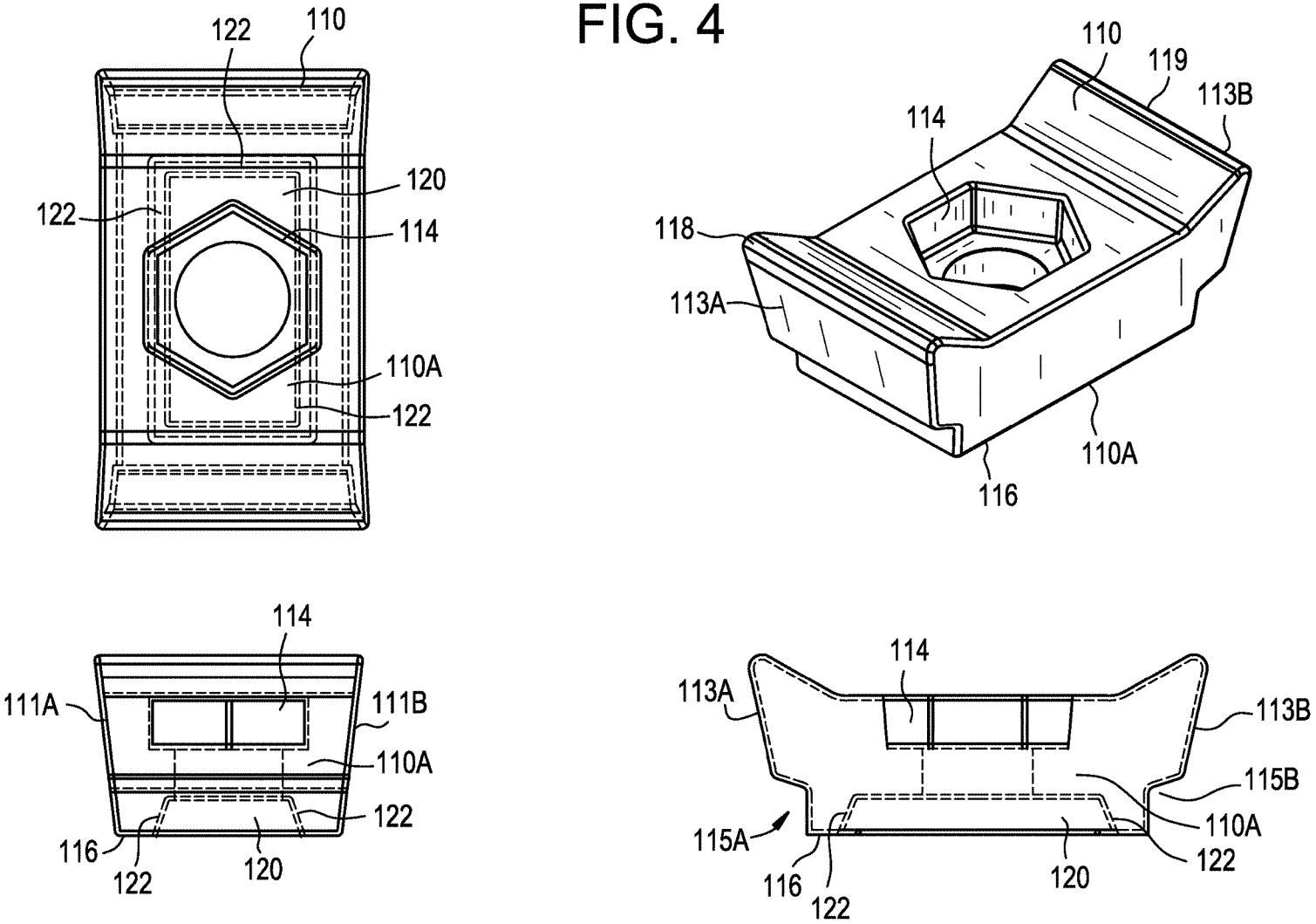
FIG. 4 illustrates various views of a tip of the cutter assembly of FIG. 3, in accordance with one embodiment of the present invention.
Figure 5:
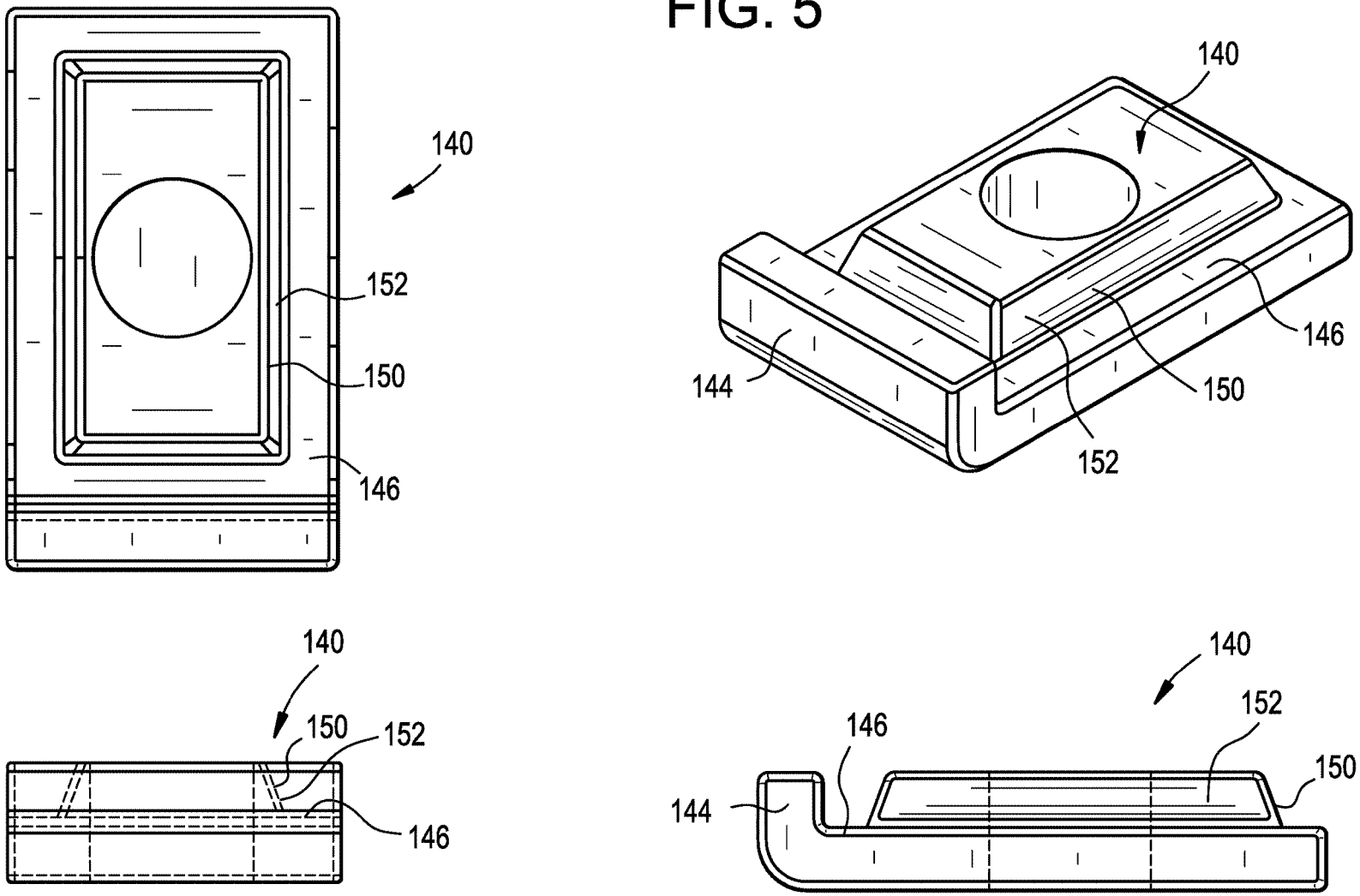
FIG. 5 illustrates various views of a base of the cutter assembly of FIG. 3, in accordance with one embodiment of the present invention.

As shown in FIGS. 3A, 4 and 5, a head of the bolt 54 is received by and held from rotating by a machined recess 114, e.g., a hex machined recess, in the body 110A of the tip 110. Accordingly, the tip 110 of the cutter assembly 100 may be selectively mounted to the base 140 by the nut 52 and the bolt 54. In accordance with the present invention, the cutter assembly 100 includes a truncated pyramid key and keyway arrangement for securely attaching the tip 110 to the base 140. For example, as shown in FIGS. 3 and 4, the tip 110 includes a cavity or keyway 120 that extends inwardly from a lower surface 116 into the body 110A of the tip 110. Side walls 122 of the keyway 120 are tapered as the side walls 122 extend upwardly and inwardly from the lower surface 116 into the body 110A of the tip 110 such that the side walls 122 have a spatial orientation substantially the same as sides of a pyramid that, for example, is truncated vertically before reaching an apex. As shown in FIGS. 3 and 5, the base 140 includes a key 150 extending upwardly from a surface 146 of the base 140 and configured to mate with the keyway 120 of the tip 110. In one embodiment, side walls 152 of the key 150 are tapered as the side walls 152 extend upwardly from the surface 146 of the base 140 such that the side walls 152 have a spatial orientation substantially the same as sides of a pyramid. In one embodiment, the side walls 152 are tapered at an angle of about forty degrees (40°), and the side walls 122 of the keyway 120 are tapered at an angle of about forty-two degrees (42°).

Figure 10A:
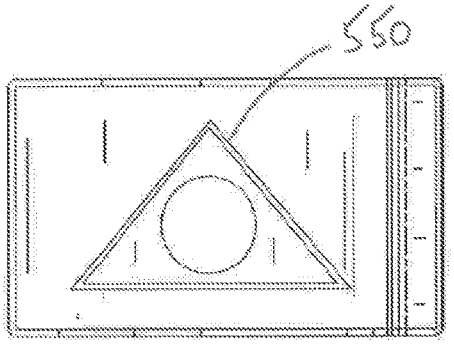
FIG. 10A is a top view of an alternate embodiment of a base of a cutter assembly of the present invention having a triangular keyway arrangement.
Figure 10B:
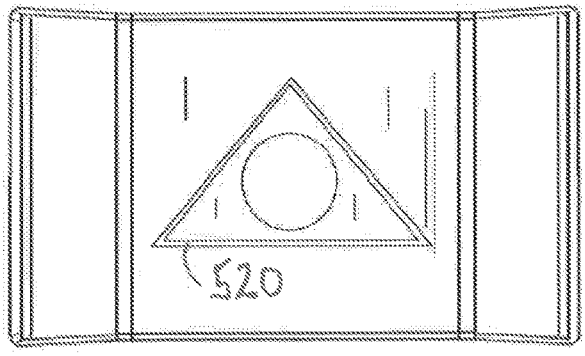
FIG. 10B is a bottom view of an alternate embodiment of a tip corresponding to the base of FIG. 10A.
Figure 11A:
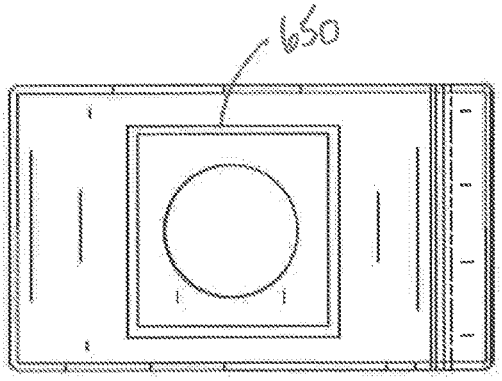
FIG. 11A is a top view of an alternate embodiment of a base of a cutter assembly of the present invention having a square keyway arrangement.
Figure 11B:
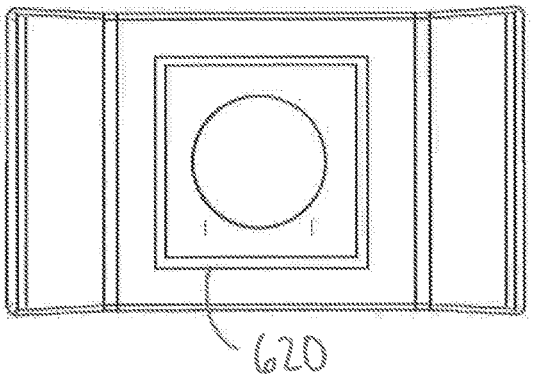
FIG. 11B is a bottom view of an alternate embodiment of a tip corresponding to the base of FIG. 11A.
Figure 13A:
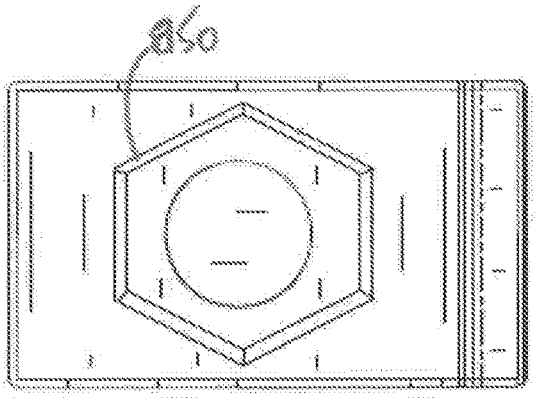
FIG. 13A is a top view of an alternate embodiment of a base of a cutter assembly of the present invention having a hexagonal keyway arrangement.
Figure 13B:
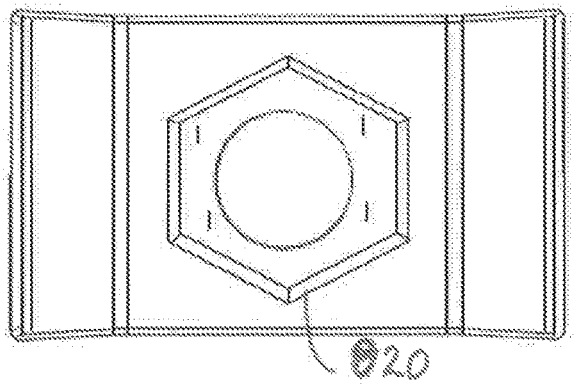
FIG. 13B is a bottom view of an alternate embodiment of a tip corresponding to the base of FIG. 13A.
Figure 12A:
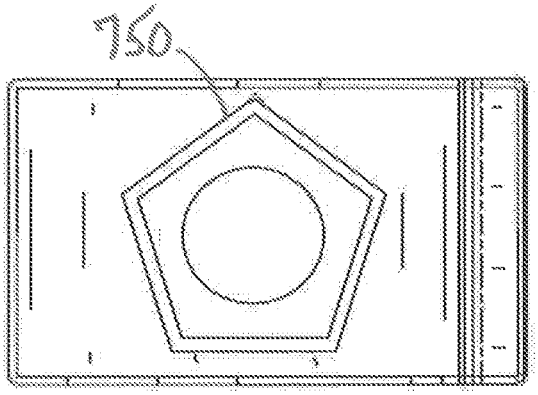
FIG. 12A is a top view of an alternate embodiment of a base of a cutter assembly of the present invention having a pentagonal keyway arrangement.
Figure 12B:
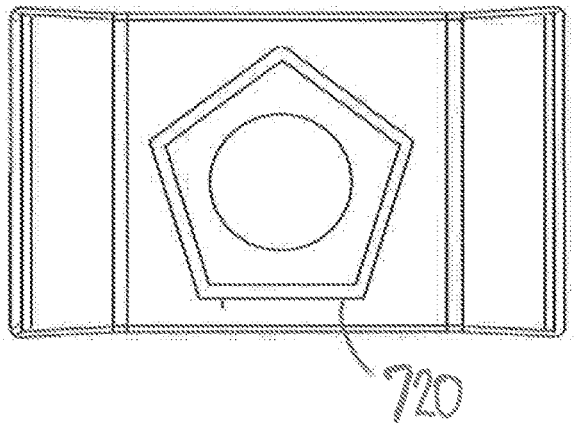
FIG. 12B is a bottom view of an alternate embodiment of a tip corresponding to the base of FIG. 12A.

As should be appreciated, the key 150 and keyway 120 are configured to provide a relatively tight fit to discourage unintended movement (e.g., sliding and/or rotational/twisting movement) of the tip 110 relative to the base 140 when assembled and in use on the hammer 20. Moreover, the truncated pyramid arrangement of the key 150 and the keyway 120 as described herein, are seen to counteract, absorb and/or distribute forces, for example, forces F1 and F2, and components thereof, for example, vertical forces F1V and F2V, and horizontal forces F1H and F2H, as shown in FIG. 3A, that have been known to impart sheering force on the bolt 54, conventional key and keyways, and otherwise defeat conventional methods of holding the tips and bases in place on the hammers 20 during grinding and crushing operation. While described above as a truncated pyramid key and keyway arrangement, it should be appreciated that the arrangement should be considered broadly. For example, it is within the scope of the present invention for such a pyramid key and keyway arrangement to include a triangular pyramid key 550 and keyway 520 as shown in FIGS. 10A and 10B, a rectangular pyramid key 150 and keyway 120 as shown in FIGS. 4 and 5, a square pyramid key 650 and keyway 620 as shown in FIGS. 11A and 11B, a pentagonal pyramid key 750 and keyway 720 as shown in FIGS. 12A and 12B, a hexagonal pyramid key 850 and keyway 820 arrangement as shown in FIGS. 13A and 13B, a star shaped pyramid key and keyway arrangement, and any other type of pyramid key and keyway arrangement that may be utilized to counteract, absorb and/or distribute forces imparted on the tip 110 and/or the base 140, individually, and/or on the cutter assembly 100, in combination. Similarly, while illustrated in the figures as having particularly dimensions for height H, length L and width W, it should be appreciated that the size of the key 150 and the keyway 120 may be altered to address one or more operational factors of one or more grinding and/or crushing machines and/or materials to be processed.

As shown in FIG. 4, in one embodiment the tip 110 includes two cutting edges 118 and 119 disposed at opposing ends of the tip 110. As one of the cutting edges 118 and 119 wears during use, the tip 110 may be removed from the base 140, rotated one hundred and eighty (180°) and remounted on the base 140 such that operation may continue using the non-worn or less worn one of the cutting edges 118 and 119. In one embodiment, illustrated in FIG. 4, side walls 111A and 111B of the tip 110 are tapered as the side walls 111A and 111B extend upwardly and outwardly from the lower surface 116. In one embodiment, the side walls 111A and 111B are tapered outwardly at an angle of about fourteen degrees (14°). In one embodiment, end walls 113A and 113B proximate the cutting edges 118 and 119 of the tip 110 are tapered as the end walls 113A and 113B extend upwardly and outwardly away from the lower surface 116. In one embodiment, the end walls 113A and 113B are tapered outwardly at an angle of about twenty-five degrees (25°). As shown in FIGS. 3, 4 and 5, in one embodiment the base 140 includes an upturned portion 144 and the tip 110 includes recessed portions 115A and 115B disposed in the end walls 113A and 113B beneath the cutting edges 118 and 119, respectively, to accommodate the upturned portion 144 of the base 140 during assembly.

It should be appreciated that while the keyway 120 and key 150 are illustrated as components of the tip 110 and base 140, respectively, it is within the scope of the present invention to interchange the position of these features such that the keyway is disposed within a body of the base 140 and the key extends downwardly from the tip 110.

Figure 6:
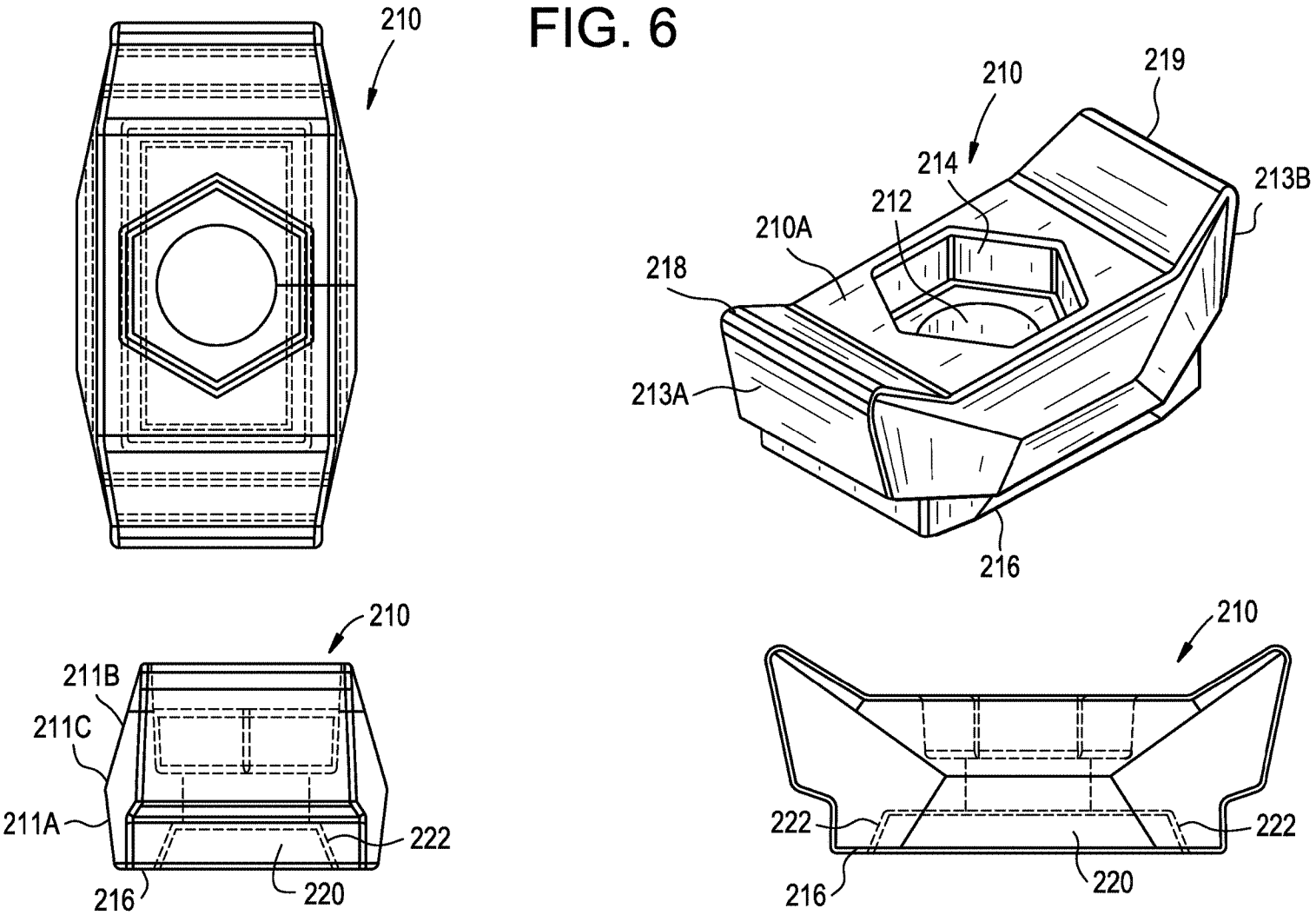
FIG. 6 illustrates various views of a tip of the cutter assembly of FIG. 3, in accordance with one embodiment of the present invention.
Figure 7:
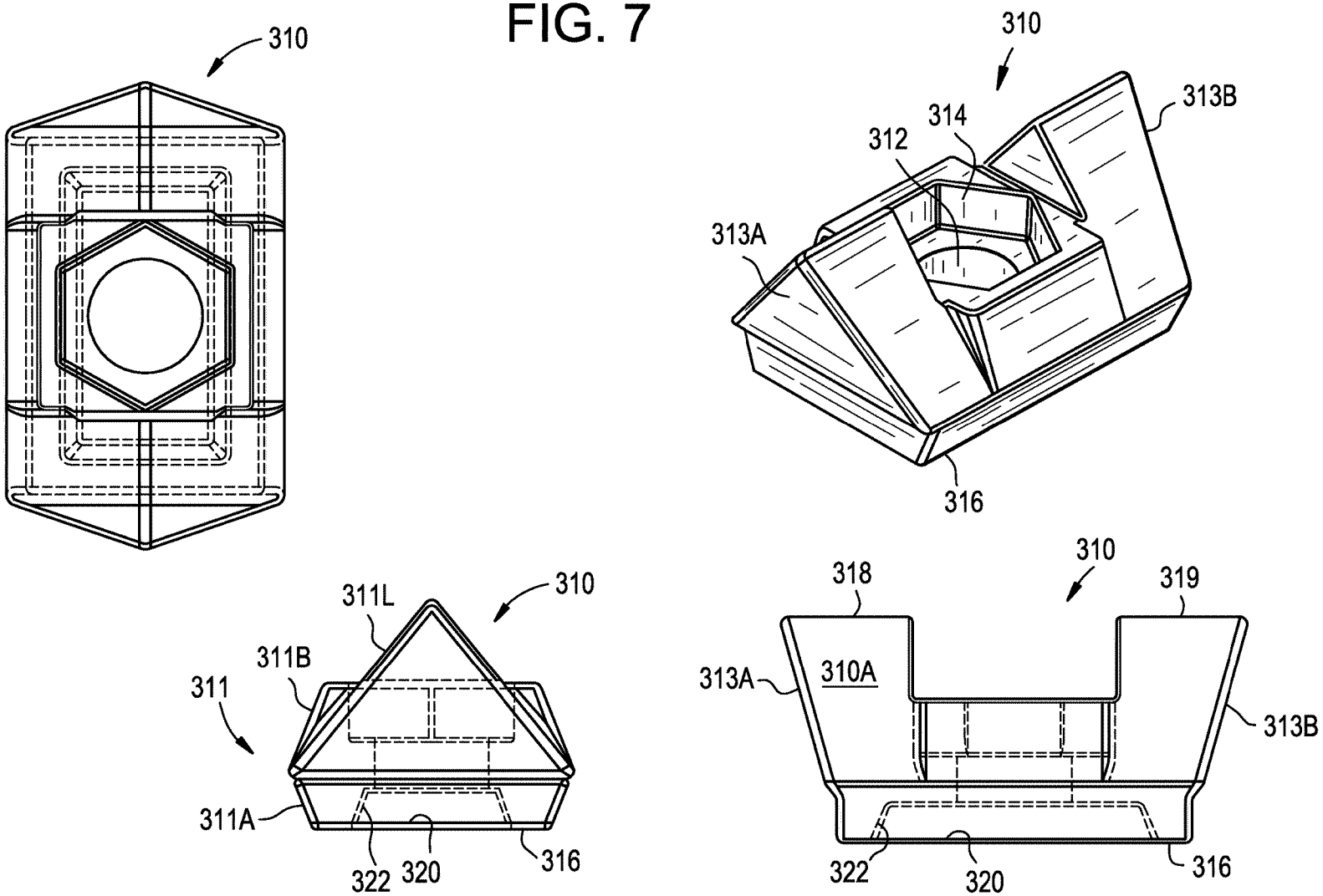
FIG. 7 illustrates various views of a tip of the cutter assembly of FIG. 3, in accordance with one embodiment of the present invention.

It should also be appreciated that, in accordance with the present invention, the cutter assembly 100 may employ a plurality of tip designs that may be used interchangeably and, when coupled with the base 140, may be mounted to one or more of the hammers 20 of a material grinding or crushing machine. For example, FIGS. 6 and 7 illustrate two such alternative tip designs, which share some common features as the tip 110 of FIG. 4. As shown in FIG. 6, a tip 210 includes two cutting edges 218 and 219, and a truncated pyramid cavity or keyway 220 that extends upwardly and inwardly from a lower surface 216 into a body 210A of the tip 210. The keyway 220 is suitably sized to accept and mate with the key 150 of the base 140. As with the tip 110, side walls 222 of the keyway 220 are tapered as the side walls 222 extend upwardly and inwardly from the lower surface 216 of the tip 210 such that the side walls 222 have a spatial orientation substantially the same as sides of a pyramid that is, for example, truncated vertically before reaching an apex. In one embodiment, the side walls 222 are tapered at an angle of about forty-two degrees (42°) to accept the side walls 152 of the key 150. The tip 210 includes side walls 211 including, for example, two surfaces 211A and 211B formed by compound angles such that a ridge or projection, shown generally at 211C, extends from each of the side walls 211. The ridge 211C protruding over the perimeter of the base 140 when the tip 210 is mounted to the base 140. In one embodiment, the first surface 211A of the side walls 211 is tapered upwardly from the lower surface 216 at an angle of about fourteen degrees (14°), and the second surface 211B of the side walls 211 is tapered inwardly from the first surface 211A at an angle of about thirty-one degrees (31°). As can be appreciated, the first surface 211A, the second surface 211B and the ridge 211C of the side walls 211 cooperate to extend the wear life of the base 140 and/or the base's attachment point to the hammer 20, for example, the weld joint 148 affixing the base 140 to the hammer 20. For example, the side walls 211 of the tip 210 defect the material 70 and/or portions being removed therefrom and minimize, if not substantially prevent, impact of the material 70 with the base 140. This defecting feature is seen to improve safety during the grinding or crushing operations. In one embodiment, the side walls 211 assist in manufacture of the tips 210 by, for example, providing a breaking point for casting or forging.

In one embodiment, end walls 213A and 213B proximate the cutting edges 218 and 219 of the tip 210 are tapered as the end walls 213A and 213B extend upwardly and outwardly away from the lower surface 216. In one embodiment, the end walls 213A and 213B are tapered outwardly at an angle of about twenty-five degrees (25°). The tip 210 also includes a bore 212 and a recess 214 in the body 210A, for example, a hex machined recess, for receiving the bolt 54 for mounting the tip 210 to the base 140 and one of the hammers 20.

As shown in FIG. 7, a tip 310 includes two cutting edges 318 and 319, and a truncated pyramid cavity or keyway 320 that extends inwardly from a lower surface 316 into a body 310A of the tip 310. The keyway 320 is suitably sized to accept and mate with the key 150 of the base 140. As with the tip 110, side walls 322 of the keyway 320 are tapered as the side walls 322 extend upwardly and inwardly from the lower surface 316 of the tip 310 such that the side walls 322 have a spatial orientation substantially the same as sides of a pyramid that is, for example, truncated vertically before reaching an apex. In one embodiment, the side walls 322 are tapered inwardly at an angle of about forty-two degrees (42°) to accept the side walls 152 of the key 150. As illustrated in a comparison between FIGS. 6 and 7, the cutting edges 318 and 319 of the tip 310 are perpendicular (e.g., rotated ninety degrees (90°)) to the cutting edges 218 and 219 of the tip 210. When the tip 310 is mounted to the base 140 and thus, secured to one of the hammers 20, the cutting edges 318 and 319 are aligned with the generally circular path 42 of the hammers 20. In one embodiment, one or more of the tips 110, 210 and 310 may be mounted to the hammers 20 such that cutting edges 118, 119, 218, 219, 318 and 319 contact materials to be ground and/or reduced at a plurality of angles to even further improve the efficiency of the grinding process.

Referring again to FIG. 7, the tip 310 includes side walls, shown generally at 311, including, for example, three surfaces 311A, 311B and 311C formed by compound angles such that two ridges or projections, shown generally at 311D and 311E, extend from each of the side walls 311. In one embodiment, the first surface 311A of the side walls 311 is tapered upwardly and outwardly from the lower surface 316 at an angle of about forty-three degrees (43°), the second surface 311B of the side walls 311 is tapered upwardly and inwardly from the first surface 311A at an angle of about forty-four degrees (44°), and the third surface 311C of the side walls 311 is tapered upwardly and inwardly from the first surface 311A at an angle of about seventy-seven degrees (77°). As with the side walls of 211 and tip 210, the side walls 311 of tip 310 cooperate to extend the wear life of the base 140 and/or the base's attachment point to the hammer 20, for example, the weld joint 148 affixing the base 140 to the hammer 20 by defecting material 70, and further assists in manufacture of the tips 310 by, for example, providing a breaking point for casting or forging.

In one embodiment, end walls 313A and 313B of the tip 310 are tapered as the end walls 313A and 313B extend upwardly and outwardly away from the lower surface 316. In one embodiment, the end walls 313A and 313B are tapered outwardly at an angle of about thirty degrees (30°). The tip 310 also includes a bore 312 and a recess 314 in the body 310A, for example, a hex machined recess, for receiving the bolt 54 for mounting the tip 310 to the base 140 and one of the hammers 20.

As noted above, during operation one or more of the tips 110, 210 and 310 may be mounted to the base 140 and thus, one or more of the hammers 20, such that cutting edges 118, 119, 218, 219, 318 and 319 contact materials to be ground and/or reduced at a plurality of angles to provide an efficient grinding process. The inventive truncated pyramid key 150 and keyway 120, 220 and 320 arrangements are seen to provide an improved mounting such that movement (e.g., slip, slide, twist and like movement) from forces generated by contact between the cutting edges of the tips 110, 210 and 310 and the materials 70 to be ground, is substantially minimized, if not eliminated. Moreover, as the cutting edges of the tips 110, 210 and 310 experience wear, the nut 52 and bolt 54 fastening the tips to the base 140 may be removed so that the tips may be rotated to expose an opposing cutting edge to wear, or the tip 110, 210 and 310 may be replaced by a new one of the tips. It should be appreciated that the configuration of the inventive pyramid key and keyway arrangement may correspond and/or be designed specifically to be used with tips having a predetermined number of cutting edges to address, for example, how one or more cutting edges may be utilized during grinding and/or crushing operations (e.g., angle incident to the circular path 42 of the hammers 20), and how the tips may be rotated during maintenance to move from a first and non-dull cutting edge or set of edges, to a second, sharpened edge or set of edges.

In these ways, the present invention allows tips 110, 210 and 310 to be quickly rotated and/or removed and replaced so that grinding operations can continue with minimal down time due to maintenance. In one embodiment, the base 140 and, in particular, the key 150 is a relatively hard surface to improve wear. For example, in one embodiment, the base 140 is comprised of 4140 steel having a hardness of about 388 Rockwell. While the tips 110, 210 and 310 may be comprised of similar materials, it is generally preferred for the tips to be relatively softer than the base 140 and thus, be allowed to deform rather than break or shatter from forces applied during operation.

Figure 8:
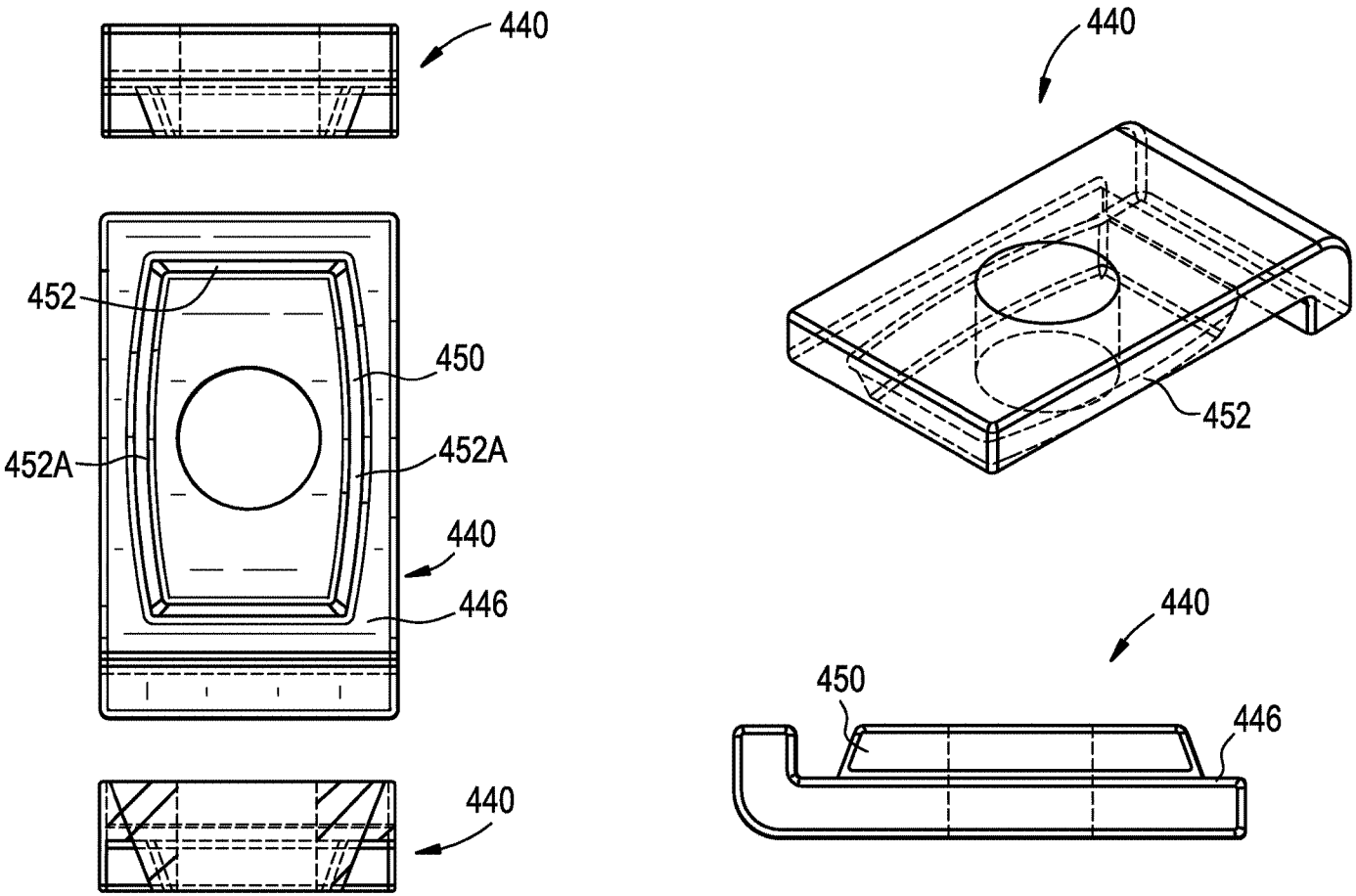
FIG. 8 illustrates various views of a base of the cutter assembly of FIG. 3, in accordance with one embodiment of the present invention.
Figure 9:
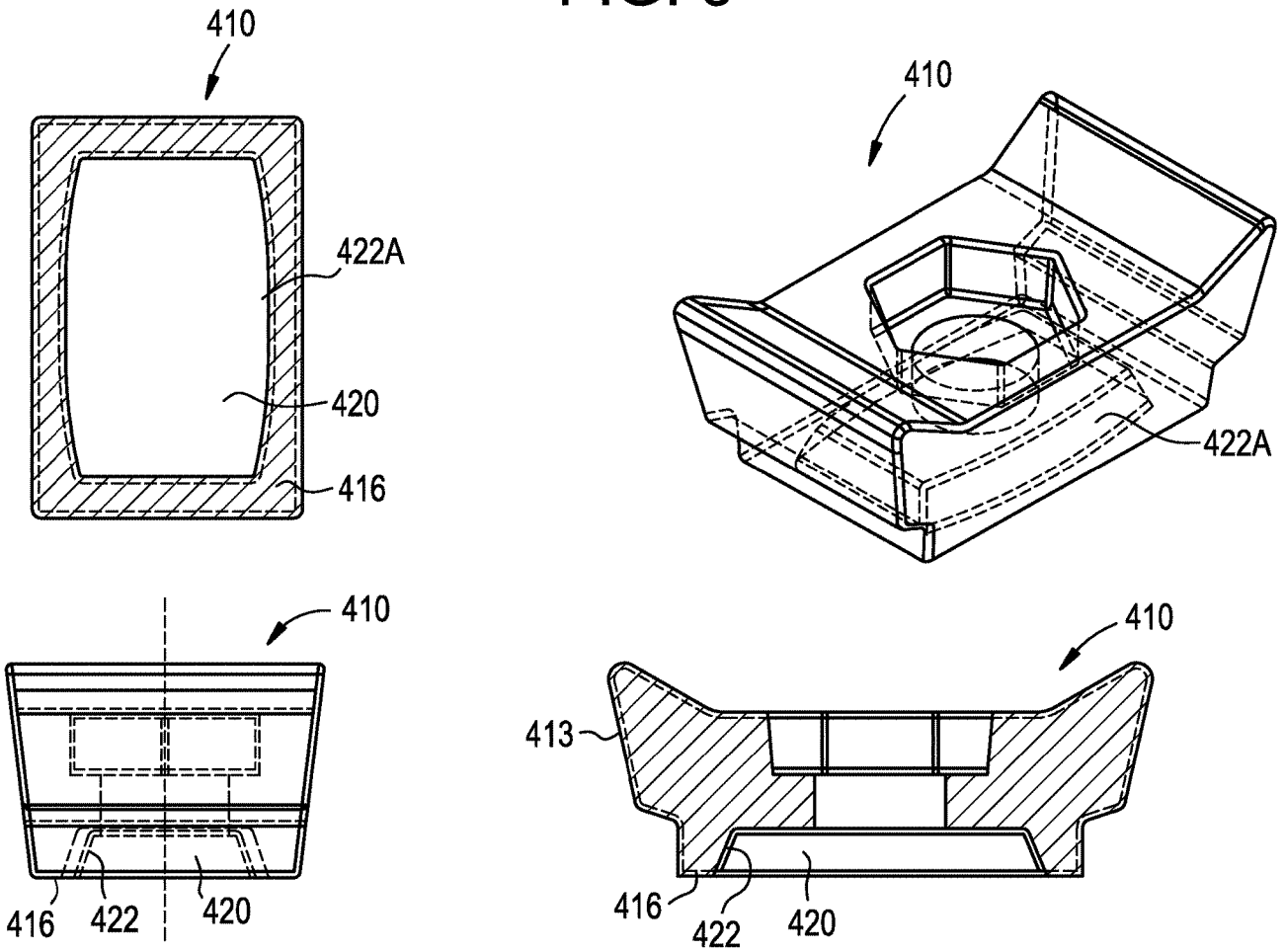
FIG. 9 illustrates various views of a tip of the cutter assembly of FIG. 3, in accordance with one embodiment of the present invention.

As shown in FIGS. 8 and 9, a tip 410 and base 440 in accordance with one embodiment of the present invention are shown. In accordance with the present invention, the cutter assembly includes a truncated pyramid key and keyway arrangement for securely attaching the tip 410 and the base 440 to the hammer 20. For example, as shown in FIG. 9, the tip 410 includes a cavity or keyway 420 that extends upwardly and inwardly from a lower surface 416 into a body 410A of the tip 410. Side walls 422 of the keyway 420 are tapered as the side walls 422 extend upwardly and inwardly from the lower surface 416 into the body 410A of the tip 410 such that the side walls 422 have a spatial orientation substantially the same as sides of a pyramid as measured in a vertical plane. As with the tip 210 and 310, the pyramid shaped side walls 422 of the keyway 420 are, for example, truncated vertically before reaching an apex.

In further reference to FIG. 9, at least two 422A of the side walls 422 are curved as the side walls 422A extend along a horizontal plane, e.g., a plane perpendicular to ends 413 of the tip 410. In the embodiment shown, the side walls 422A have a constant radius of curvature defined by a radius R1 of, for example, about 7.865 inches. It should be understood, however, the radius of curvature R1 may vary along the length of the sidewalls 422A. It should also be understood that each side wall 422 may have a different radius of curvature R.

As shown in FIG. 8, the base 440 includes a key 450 extending upwardly from a surface 446 of the base 440 and configured to mate with the keyway 420 of the tip 410. In the embodiment shown, side walls 452 of the key 450 are tapered as the side walls 452 extend upwardly and inwardly from the surface 446 of the base 440 such that the side walls 452 have a spatial orientation substantially the same as sides of a truncated pyramid as measured in a vertical plane. In one embodiment, the side walls 452 are tapered upwardly and inwardly at an angle of about forty degrees (40°), and the side walls 422 of the keyway 420 are tapered upwardly and inwardly at an angle of about forty-two degrees (42°).

In further reference to FIG. 8, at least two 452A of the side walls 452 are curved as the side walls 452A extend upwardly and inwardly in a horizontal plane, e.g., a plane perpendicular to an end 442 of the base 440. In the embodiment shown, the side walls 452A have a constant radius of curvature defined by a radius R2 of, for example, about 7.745 inches. It should be understood, however, the radius of curvature R2 may vary along the length of the side walls 452. It should further be understood that the radius of curvature R1 of the side wall 422 of the keyway 420 and the radius of curvature R2 of the side wall 452 of the key 450 are substantially the same so as to provide for relatively tight fit and prevent slippage of the tip 410 relative to the base 440.

As should be appreciated, the key 450 and keyway 420 are configured to provide a relatively tight fit to discourage unintended movement (e.g., sliding, twisting or like movement) of the tip 410 relative to the base 440 when assembled and in use on the hammer 20. Moreover, by providing sidewalls in the key and keyway that are curved in the horizontal plane, as described herein, the additional benefit of ensuring a mating fit (e.g., orientation) between side walls of the key 450 and associated keyway 420 is provided.

It should be appreciated that while the keyway 420 and key 450 are illustrated as components of the tip 410 and base 440, respectively, it is within the scope of the present invention to interchange the position of these features such that the keyway is disposed within a body of the base 440 and the key extends downwardly from the tip 410.

The terms "first," "second," and the like, herein do not denote any order, quantity, or importance, but rather are used to distinguish one element from another. In addition, the terms "a" and "an" herein do not denote a limitation of quantity, but rather denote the presence of at least one of the referenced item.

Although the invention has been described with reference to particular embodiments thereof, it will be understood by one of ordinary skill in the art, upon a reading and understanding of the foregoing disclosure that numerous variations and alterations to the disclosed embodiments fall within the spirit and scope of this invention and of the appended claims. For example, those of ordinary skill in the art should recognize that one or more of the angles and dimensions of various structural features of the invention may be altered without deviating from the scope of the present invention.

What is claimed is:

1. A cutter assembly for mounting to one or more hammers of a rotor assembly for a grinding machine, the cutter assembly comprising:

a base mounted to a hammer of a rotor assembly, the base having a truncated triangular pyramid key extending upwardly and inwardly at a first angle from a surface of the base and a first center bore through the base, the truncated triangular pyramid key surrounding the first center bore;

a tip having a truncated triangular pyramid keyway extending upwardly and inwardly at a second angle from a lower surface into a body of the tip, the truncated triangular pyramid keyway configured to mate with the truncated triangular pyramid key of the base, the tip including at least one cutting edge disposed on an end of the tip, a second center bore through the body of the tip, and a recess in the body, the recess being concentric with the second center bore, the truncated triangular pyramid keyway surrounding the second center bore;

a truncated triangular pyramid arrangement formed by the truncated triangular pyramid key of the base being received within the truncated triangular pyramid keyway of the tip, the truncated triangular pyramid arrangement configured to distribute vertical forces and horizontal forces that impart a sheering force; and a fastener extending through the first center bore and the second center bore, the fastener being received by the hammer to secure the base and tip to the hammer, the fastener having a head being received within the recess.

2. The cutter assembly of claim 1, wherein:

the key includes three key side walls that taper upwardly from the surface of the base such that the three key side walls have a spatial orientation substantially the same as sides of a pyramid; and the keyway includes three keyway side walls that taper inwardly from the lower surface of the tip such that the three keyway side walls have a spatial orientation substantially the same as sides of a pyramid.

3. The cutter assembly of claim 2, wherein:

at least a portion of a key side wall is curved in a plane parallel to the surface of the base; and at least a portion of a keyway side wall is curved in a plane parallel to the surface of the base and configured to mate with the curved key sidewall portion.

4. The cutter assembly of claim 3, wherein:

the curved portion of the key sidewall has a first radius of curvature; and the curved portion of the keyway sidewall has a second radius of curvature;

wherein the second radius of curvature is greater than the first radius of curvature.

5. A cutter assembly for mounting to one or more hammers of a rotor assembly for a grinding machine, the cutter assembly comprising:

a base mounted to a hammer of a rotor assembly, the base having a truncated pentagonal pyramid key extending upwardly and inwardly at a first angle from a surface of the base and a first center bore through the base, the truncated pentagonal pyramid key surrounding the first center bore;

a tip having a truncated pentagonal pyramid keyway extending upwardly and inwardly at a second angle from a lower surface into a body of the tip, the truncated pentagonal pyramid keyway configured to mate with the truncated pentagonal pyramid key of the base, the tip including at least one cutting edge disposed on an end of the tip, a second center bore through the body of the tip, and a recess in the body, the recess being concentric with the second center bore, the truncated pentagonal pyramid keyway surrounding the second center bore;

a truncated pentagonal pyramid arrangement formed by the truncated pentagonal pyramid key of the base being received within the truncated pentagonal pyramid keyway of the tip, the truncated pentagonal pyramid arrangement configured to distribute vertical forces and horizontal forces that impart a sheering force; and a fastener extending through the first center bore and the second center bore, the fastener being received by the hammer to secure the base and tip to the hammer, the fastener having a head being received within the recess.

6. The cutter assembly of claim 5, wherein:

the key includes five key side walls that taper upwardly from the surface of the base such that the five key side walls have a spatial orientation substantially the same as sides of a pyramid; and the keyway includes five keyway side walls that taper inwardly from the lower surface of the tip such that the five keyway side walls have a spatial orientation substantially the same as sides of a pyramid.

7. The cutter assembly of claim 6, wherein:

at least a portion of a key side wall is curved in a plane parallel to the surface of the base; and at least a portion of a keyway side wall is curved in a plane parallel to the surface of the base and configured to mate with the curved key sidewall portion.

8. The cutter assembly of claim 7, wherein:

the curved portion of the key sidewall has a first radius of curvature; and the curved portion of the keyway sidewall has a second radius of curvature;

wherein the second radius of curvature is greater than the first radius of curvature.

9. A cutter assembly for mounting to one or more hammers of a rotor assembly for a grinding machine, the cutter assembly comprising:

a base mounted to a hammer of a rotor assembly, the base having a truncated hexagonal pyramid key extending upwardly and inwardly at a first angle from a surface of the base and a first center bore through the base, the truncated hexagonal pyramid key surrounding the first center bore;

a tip having a truncated hexagonal pyramid keyway extending upwardly and inwardly at a second angle from a lower surface into a body of the tip, the truncated hexagonal pyramid keyway configured to mate with the truncated hexagonal pyramid key of the base, the tip including at least one cutting edge disposed on an end of the tip, a second center bore through the body of the tip, and a recess in the body, the recess being concentric with the second center bore, the truncated hexagonal pyramid keyway surrounding the second center bore;

a truncated hexagonal pyramid arrangement formed by the truncated hexagonal pyramid key of the base being received within the truncated hexagonal pyramid keyway of the tip, the truncated hexagonal pyramid arrangement configured to distribute vertical forces and horizontal forces that impart a sheering force; and a fastener extending through the first center bore and the second center bore, the fastener being received by the hammer to secure the base and tip to the hammer, the fastener having a head being received within the recess.

10. The cutter assembly of claim 9, wherein:

the key includes six key side walls that taper upwardly from the surface of the base such that the six key side walls have a spatial orientation substantially the same as sides of a pyramid; and the keyway includes six keyway side walls that taper inwardly from the lower surface of the tip such that the six keyway side walls have a spatial orientation substantially the same as sides of a pyramid.

11. The cutter assembly of claim 10, wherein:

at least a portion of a key side wall is curved in a plane parallel to the surface of the base; and at least a portion of a keyway side wall is curved in a plane parallel to the surface of the base and configured to mate with the curved key sidewall portion.

12. The cutter assembly of claim 11, wherein:

the curved portion of the key sidewall has a first radius of curvature; and the curved portion of the keyway sidewall has a second radius of curvature;

wherein the second radius of curvature is greater than the first radius of curvature hexagonal.

13. A cutter assembly for mounting to one or more hammers of a rotor assembly for a grinding machine, the cutter assembly comprising:

a base mounted to a hammer of a rotor assembly, the base having a truncated pyramid key extending upwardly and inwardly at a first angle from a surface of the base and at least one first bore through the base, the truncated pyramid key surrounding the at least one first bore;

a tip having a truncated pyramid keyway extending upwardly and inwardly at a second angle from a lower surface into a body of the tip, the truncated pyramid keyway configured to mate with the truncated pyramid key of the base, the tip including at least one cutting edge disposed on an end of the tip, at least one second bore through the body of the tip corresponding to the at least one first bore of the base, and a recess in the body, the truncated pyramid keyway surrounding the at least one second bore;

a truncated pyramid arrangement formed by the truncated pyramid key of the base being received within the truncated pyramid keyway of the tip, the truncated pyramid arrangement configured to distribute vertical forces and horizontal forces that impart a sheering force; and at least one fastener extending through the at least one first bore and the at least one second bore, the at least one fastener being received by the hammer to secure the base and tip to the hammer, the at least one fastener having a head being received within the recess.

* * * * *